US006673752B2

(12) United States Patent
Bookbinder et al.

(10) Patent No.: US 6,673,752 B2
(45) Date of Patent: Jan. 6, 2004

(54) HIGH PERFORMANCE CUTTING FLUIDS FOR GLASSY, CRYSTALLINE, OR AGGREGATE MATERIALS

(75) Inventors: Dana C. Bookbinder, Corning, NY (US); David F. Dawson-Elli, Shrewsbury, MA (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/916,879

(22) Filed: Jul. 27, 2001

(65) Prior Publication Data

US 2002/0034923 A1 Mar. 21, 2002

Related U.S. Application Data

(60) Provisional application No. 60/221,435, filed on Jul. 28, 2000.

(51) Int. Cl.[7] ..... C10M 139/04; C10M 173/02; B26D 7/08

(52) U.S. Cl. ..... 508/206; 508/204; 508/207; 508/421; 83/22; 83/169

(58) Field of Search ..... 83/169; 508/204, 508/206, 207

(56) References Cited

U.S. PATENT DOCUMENTS

| | | | | |
|---|---|---|---|---|
| 3,756,052 A | * | 9/1973 | Quaal et al. | 72/42 |
| 3,922,821 A | | 12/1975 | Canterbury | 51/284 |
| 4,572,791 A | | 2/1986 | Onopchenko et al. | 252/46.3 |
| 4,828,735 A | | 5/1989 | Minagawa et al. | 252/49.3 |
| 4,959,164 A | | 9/1990 | Engelmann | 252/8.51 |
| 4,973,724 A | | 11/1990 | Nelson | 556/465 |
| 5,021,262 A | | 6/1991 | Bouillard et al. | 427/289 |
| 5,196,401 A | | 3/1993 | Engelmann | 507/120 |
| 5,461,008 A | | 10/1995 | Sutherland et al. | 437/226 |
| 5,507,962 A | | 4/1996 | Jahanmir et al. | 252/49.3 |
| 5,534,172 A | | 7/1996 | Perry et al. | 508/156 |
| 5,678,466 A | * | 10/1997 | Wahl | 83/168 |
| 5,716,705 A | | 2/1998 | Wirth et al. | 428/391 |
| 6,242,391 B1 | | 6/2001 | Fukutani et al. | 508/180 |
| 6,258,759 B1 | | 7/2001 | Futahashi et al. | 508/143 |

FOREIGN PATENT DOCUMENTS

EP 0 369 692 B1 5/1993

OTHER PUBLICATIONS

Pamela J. Watson et al., "Chemically Enhanced Drilling, An Annotated Tabulation of Published Results", United States Department of the Interior, Bureau of Mines, pp. Introduction—53.

William H. Engelmann et al., "Zeta Potential Control For Enhanced Drilling of Taconite and Other Hard Rocks", 60$^{th}$ Annual Meeting of the Minnesota Section, AIME 48$^{th}$ Annual Mining Symposium, Jan. 14–15, 1987, pp. 6–1 to 6–22.

William H. Engelmann et al., "Zeta Potential Control for Simultaneous Enhancement of Penetration Rates and Bit Life in Rock Drilling", United States Department of Interior, Bureau of Mines, 1987, pp. 1–18.

* cited by examiner

*Primary Examiner*—Ellen M. McAvoy
(74) *Attorney, Agent, or Firm*—Vincent T. Kung

(57) ABSTRACT

A cutting fluid applicable for the machining of vitreous, crystalline or aggregate materials such as glass, glass-ceramics, ceramics, stone, concrete, silicon and the like. The cutting fluid comprises a solution containing organic molecules—in particular silanes, silanols, and siloxanes—capable of forming covalent bonds with such vitreous, crystalline or aggregate materials. The organic molecules in the cutting fluid is believed to improve the rate of manufacturing productivity, surface finish quality, and decrease the incidence of sub-surface damage caused by particulate adhesion to the cutting or abrading tool during a machining process of these kinds of substrates. The reduced clogging of cutting surfaces and increased lubricity of the cutting fluid may also prolong the useful life of the machining tools when used against these kinds of substrates.

71 Claims, 5 Drawing Sheets

FIG. 5 CUTTING OF FUSED SILICA: COMPARISON OF CUTTING FLUIDS PLOT OF APPLIED FORCE VS. MATERIAL REMOVED IN 60 SECONDS.
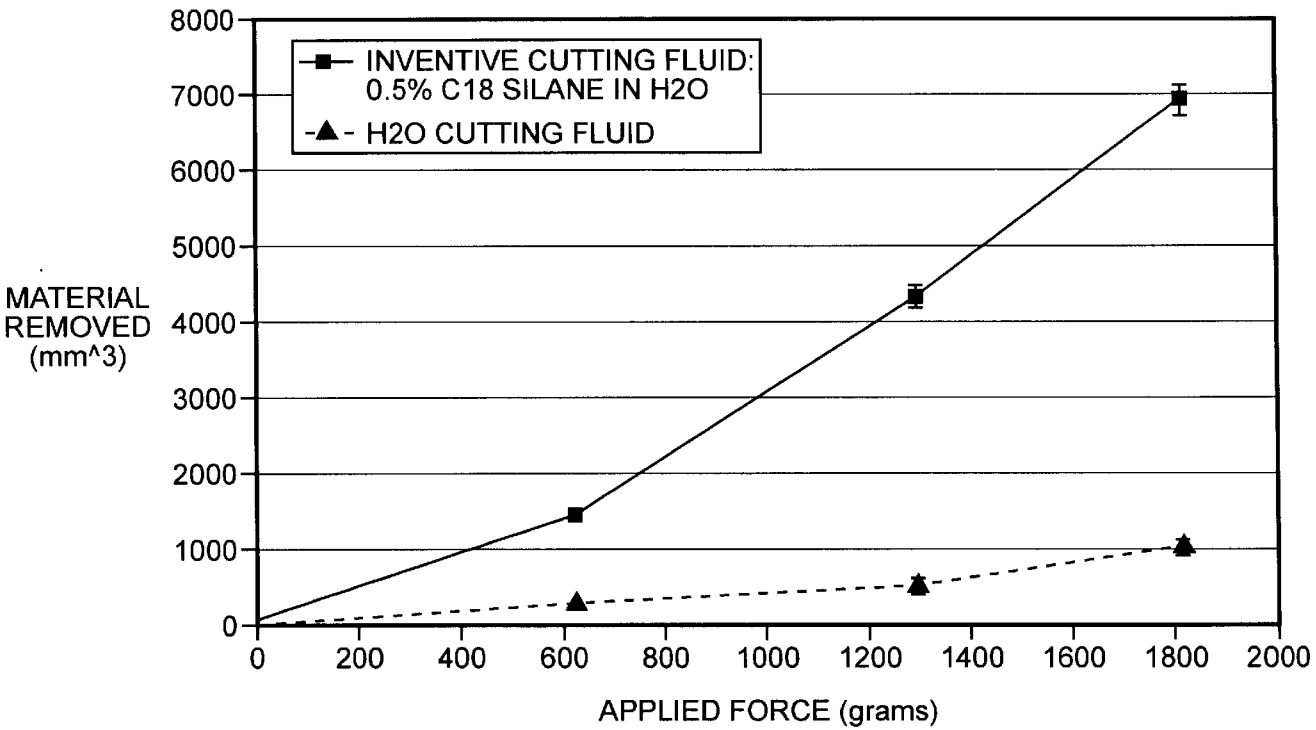

FIG. 6 CORE DRILLING OF FUSED SILICA: COMPARISON OF CUTTING FLUIDS PLOT OF FEED RATE VS. SURFACE ROUGHNESS AND FRACTURE.
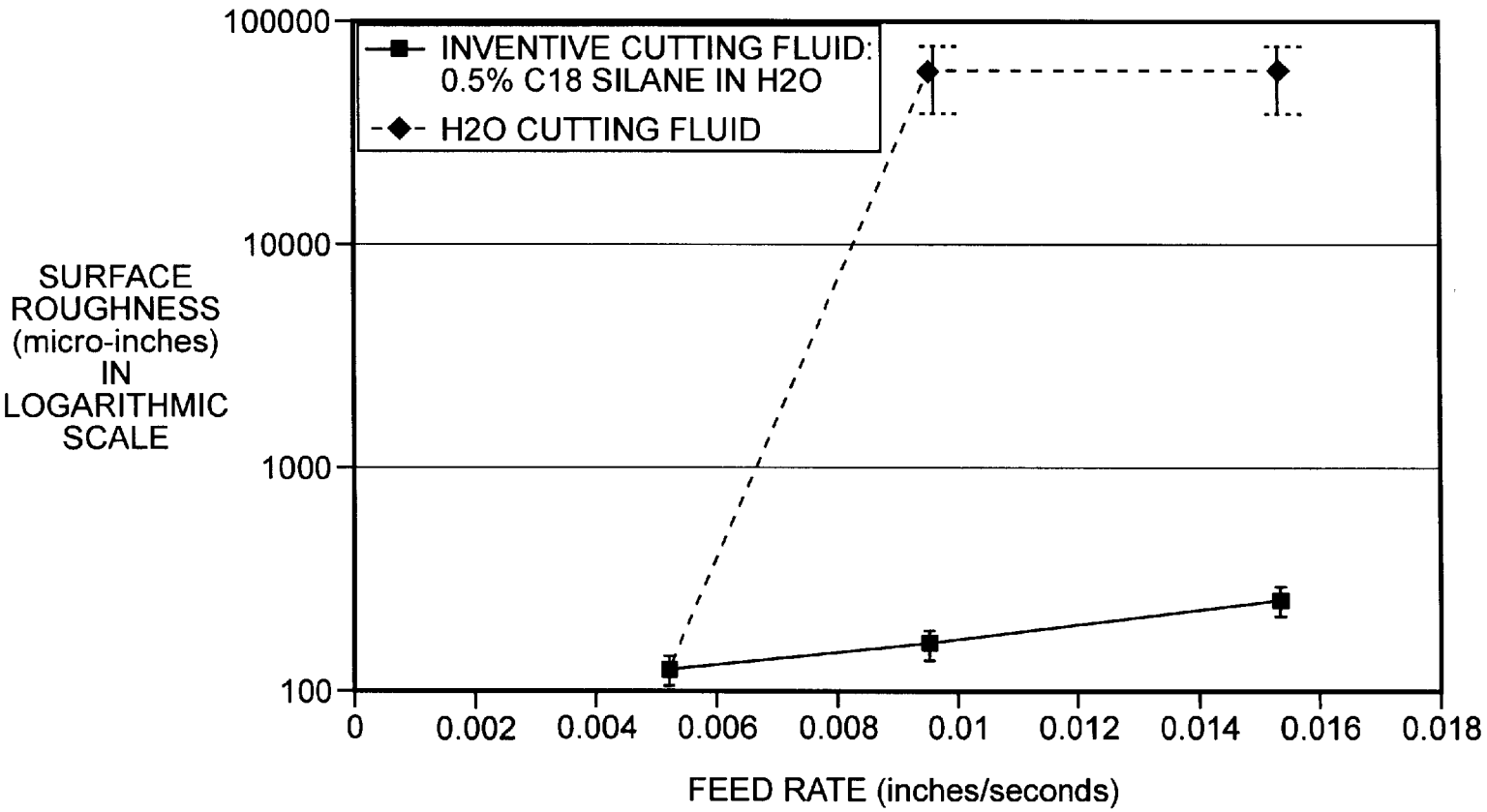

HIGH PERFORMANCE CUTTING FLUIDS FOR GLASSY, CRYSTALLINE, OR AGGREGATE MATERIALS

CLAIM OF PRIORITY

This Application claims priority to U.S. Provisional Application Ser. No. 60/221,435, filed on Jul. 28, 2000, in the names of Dana C. Bookbinder and David F. Dawson-Elli.

FIELD OF INVENTION

This invention relates to organic cutting fluids that can facilitate the abrading, cutting or machining of vitreous, crystalline, or aggregate materials, and that may also be used as protective coatings on vitreous, crystalline, or aggregate materials.

BACKGROUND

Cutting, abrading, grinding, polishing, and other machining operations performed upon glass, ceramic, metal, stone, or other vitreous, crystalline, or aggregate materials have to date been associated with problems such as rapid dulling of the cutting or grinding tools, long processing times, and unduly rough or excessively scratched final surfaces. All of which have resulted in large amounts of waste, high manufacturing costs, shortened life of tools, and less than desired end products.

To minimize these problems, the machining of vitreous, crystalline, or aggregate materials often require lubrication with cutting or wetting fluids such as water or other liquid solutions. Cutting fluids typically reduce fiction between the cutting edge of a machining tool and the material being worked upon. Some cutting fluids also protect the workpiece from scratches and contamination caused by the deposit of abrasive particles or chips made during the machining process on workpiece surfaces. In general, a cutting fluid can also function as a coolant for the cutting or grinding tool.

In attempts to enhance the cutting or abrading actions and increase the better finishing of surfaces, cutting fluids used to date have fallen into four general categories of: (1) straight oils, usually light mineral oils or kerosene; (2) water-soluble emulsions which contain oil and surfactants for emulsifying the oil; (3) semi-synthetic types which contain relatively small amounts of oil and large percentages of surfactants or detergents; and (4) synthetic, chemical or solution types which contain no oil, but rely on various chemical compounds to achieve desired properties. The cutting fluid formulations in the first three categories, which require surfactants, traditionally use anionic or non-ionic surface-active agents for reducing surface tension, supplying lubricity and emulsifying oil content. The cationic fluids found in the fourth general category have traditionally not performed well as glass or ceramic machining fluids, nor have they been readily accepted for such purposes in view of one or more of their draw backs, such as excessive foaming, or the deposit of difficult to remove residue upon the machines and workpieces. Additionally, the lubricating properties of prior art cationic fluids are less than optimum and some have been excessively corrosive to machinery.

In the past, cationic compounds have been used in rock drilling but have not performed well as cutting fluids for operations on glass or glass-ceramic substrates. Some of the drawbacks include excessive foaming, the deposit of difficult to remove residue upon the machining tools and workpieces, the slow settling of cut particulate residue in the cutting fluid and difficult to remove from the workpiece. Moreover, the lubricating properties of prior art cationic fluids are less than optimum and some have been excessively corrosive to the machining tools. As a result of some of these drawbacks, the current predominant practice is to use plain water as the lubricating and flushing fluid when cutting or abrading glassy, crystalline or aggregate materials. Thus, there is a need for a novel cutting fluid used for machining glass, glass-ceramic, silicon, crystalline, and stone materials.

An objective of the present inventive cutting fluid is to achieve a slippery coating on all vitreous, crystalline or aggregate substrate surfaces that come into contact with the cutting surfaces of machining tools. With a slippery cutting fluid coating, the machining tool generates less friction and heat, tends to work easier against the substrate, removes more material at a faster rate, and creates potentially a better surface finish. By referring to these recited qualities, we hope to clarify the term "high performance" by which we describe the inventive cutting fluid, and how the fluid enables a machine tool, such as a blade or drill bit, when used in conjunction with the cutting fluid, to cut or work faster without creating, or at least minimizing the occurrence of surface fractures or damage.

SUMMARY OF THE INVENTION

This invention incorporates organic molecules in aqueous solution and uses the solution as a cutting fluid during the working or machining of vitreous, crystalline, or aggregate materials, such as glass—especially, high (>85%) silicate-content glasses and/or fused silica—quartz, crystalline bodies, glass ceramics, ceramics, rock or stone—especially, granite, marble, limestone, sandstone—concrete, metallic materials, silicon, silicon-carbide, and the like. The cutting fluid comprises a solution containing organic molecules capable of bonding with such vitreous, crystalline, or aggregate materials. It is believe that the organic molecules will improve the manufacturing productivity, surface finish quality, and decrease the incidence of sub-surface damage in these kinds of substrates.

In one embodiment of the invention the cutting fluid consists of organic molecules of selected from cationic phosphonium compounds in solution. In a preferred embodiment, silane solutions are used as cutting fluids. The silanes are organosilanes, siloxanes, or silanols, having molecular substituents that include alkyl, phenylated, branched, unbranched, or cyclic carbon groups, as well as oxygen and halides. It is believed that silanes have not been used as cutting fluids, especially for vitreous, crystalline or aggregate materials. Silane compounds exhibit properties that can form covalent bonds with a workpiece's surfaces. The organic molecules bind rapidly to inorganic particles, such as glass, glass ceramics, ceramics, or other inorganic oxides. Ordinarily these particles or milled chips will clog the abrading surface of a cutting tool. The organic molecules prevent the inorganic particles from readily binding to each other and or the abrading surface of the cutting tool. Thus, when the tool remains largely free of particles (unclogged), the tool can cut faster, using less pressure, and cause less surface and subsurface damage.

As contemplated in this invention, cutting or abrading tools are kept free of substrate particulates and are prevented from clogging through out the normal cutting or machining process. Due to their covalent nature and lubricating properties, silane molecules in the cutting fluid tend to bond to the surfaces of the substrate materials, and lubricates the tool-workpiece interface, minimizing both tool-wear and heating due to friction. Moreover, minimal tool-workpiece interface pressures are required and cutting or machining times are substantially shortened with the resulting realization of considerable economic advantage and improved product quality. Additionally, in view of the free flowing characteristics of the inventive cutting fluid, it readily carries away grinding swarf and permits rapid settling of the swarf in the used fluid as a relatively hard and easily filtered precipitate.

Other advantages and characteristics of the invention will become apparent from the following detailed description read in conjunction with the accompanying illustrative drawings.

BRIEF DESCRIPTION OF THE DRAWINGS

FIG. 5. A data plot showing a comparison of the relative amount of material removed from a given substrate using the prior art and the inventive cutting fluids, respectively, while under a constant force.

FIG. 6. A logarithmic plot showing the relative comparison of surface roughness versus workpiece cutting speed.

DETAILED DESCRIPTION OF THE INVENTION

Figure 1:
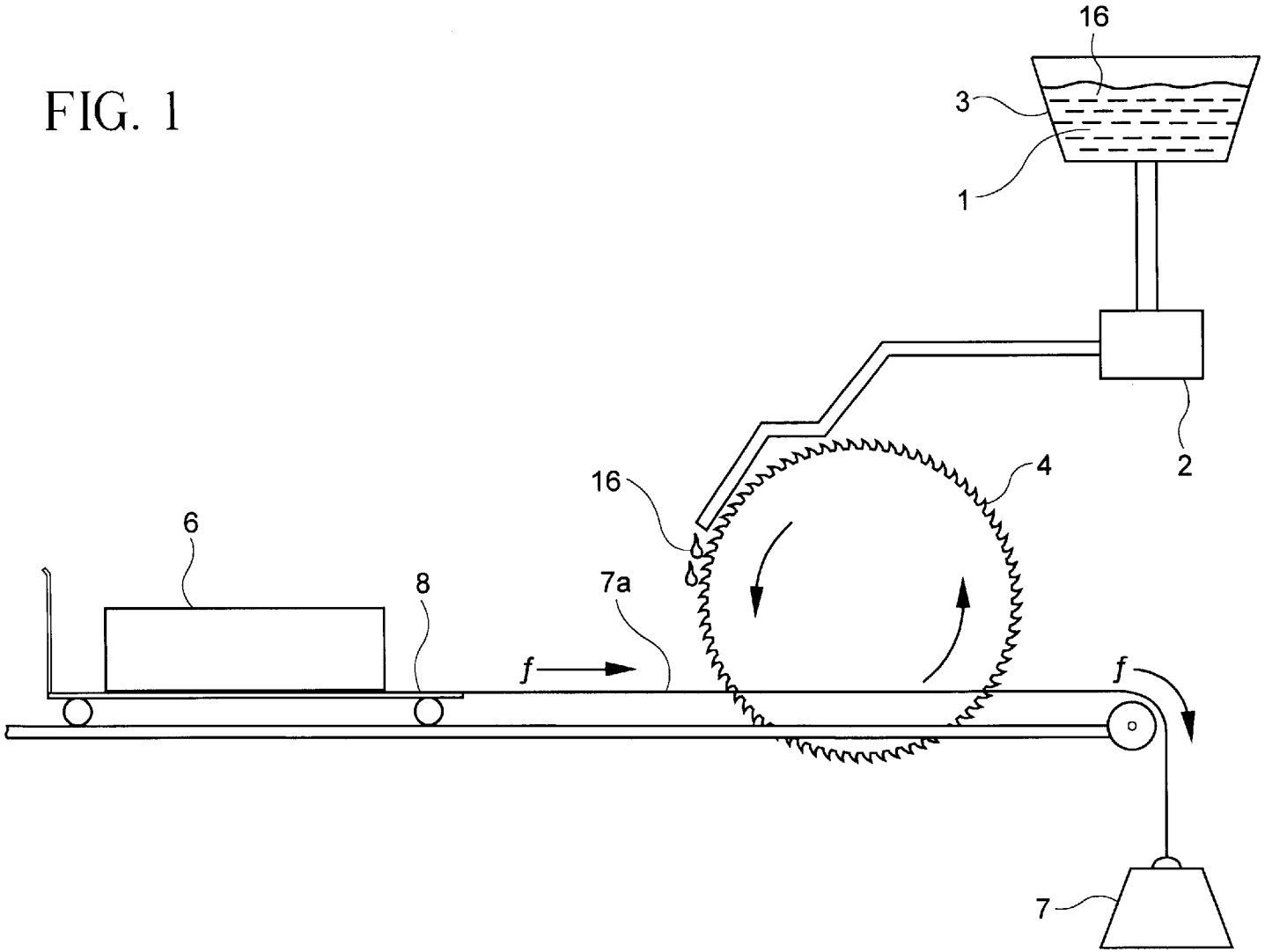
FIG. 1. A schematic diagram of an exemplary type of cutting or grinding operation using the inventive cutting fluid and which may be performed according to the invention.

During the machining process of vitreous, crystalline or aggregate materials, the cutting tools that are employed generate a large amount of friction and heat. Often this kind of friction results from the cutting tool, such as the teeth of saw blades, grinders, or drill bits, becoming clogged by the adhesion of microparticles upon both the cutting blade and substrate surfaces. This increase in friction, roughens the cutting or machining process, because it can lead to greater vibrations during a cut, which can crack the substrate. Hence, the articles produced by the process often require further finishing steps that can add to cost, labor and time. Moreover, the high friction forces require that more energy be expended to drive the cutting tool through the substrate and other measures be used to steady the cut against the heightened amount of vibrations, not to mention causing the shortening of the useful life of the cutting tools.

The cutting fluid of the present invention is addressed to cutting or abrading operations that involve the cutting of vitreous, crystalline, and aggregate materials. More particularly, a preferred application of the inventive fluid is used in cutting multilayer-glass optical filters, as well as other glass and glass-ceramic articles, silicon wafers, and quarry stone. The vitreous, crystalline, or aggregate articles can have a form selected from one of the following, including a slab, wafer, bulk glass, sheet, disk, washer, cane, tube, cone, and ribbon. As used herein, the term "cutting or machining" a vitreous, crystalline or aggregate substrate refers to the function or operation of a tool designed for abrading, grinding, polishing, edging, incising, sawing, shearing, severing, and the like. For instance, the present cutting fluid is particularly suited for operations such as diamond turning or machine tooling and other like processes.

It is believed that either ionic, hydrogen bonding or van der Waal forces cause the particulates to adhere to the surface of cut substrate and cutting tool. The relatively large flat surface areas of particulates and the substrate promote adherence. The close molecular attraction between particles is overcome when using the present, inventive cutting fluid. The cutting fluid coats the substrate, the cutting tool, and any particulate, such as small glass chips, fine ceramic or metallic shards, or dust, that may be generated during the cutting or abrading of vitreous, crystalline, or aggregate matter, with a very thin layer (approximately 3 nm) of a "slippery" organic compound.

The cutting fluid of the present invention comprises an organic compound having an amphiphilic configuration suspended in solution. The organic molecule have a polar head, where a leaving group can react with other groups located on the surface of the substrate material to form covalent bonds linking the organic molecule with the substrate. Preferably, the organic molecules of the cutting fluid are silanes or siloxanes possessing a hydrocarbon or fluorocarbon structure and at least one leaving group that can form a covalent bond with hydroxyl groups located on the surface of the substrate. Preferably the tails do not interact with each other, and do not bond to the substrate surface. Thus, only one end of the organic molecule has at least one reactive end group that bonds. The other end is inert under normal processing conditions to prevent the organic molecule from bonding to itself and forming a large cross-link mass, or to reactive groups on the surface of the substrate materials.

The silane molecules, which are dispersed in the cutting fluid, bond instantly, on contact, to the substrate material to form a slippery surface. Stated generally, it is thought that any substrate having a surface comprised of "surface oxygen," by which is meant that the material contains, at its surface oxygen which is covalently bound in the material, which oxygen is capable of being covalently bonded to silanes. More specifically, the surface oxygen is considered within the scope of the invention if the oxygen reacts with any silane to form O—Si—R bonds. Additionally, the silanes (R—Si—$O_x$) of the invention bind with the particles that are milled-off of the substrate material and other contaminants forming what is believed to be a RSiO—Si: covalent bond, where R—Si—$O_x$ is a hydrocarbon or fluorocarbon silane, thus preventing clumping of the particles to themselves, the workpiece substrate, or the cutting surfaces of a machining tool. Moreover, when used in water as is preferred for this invention, the silane molecules typically hydrolyze to form R—Si—OH. These terminal hydroxyl groups also readily bond to inorganic materials, which may not necessarily be oxides.

Some examples of preferred materials to which the cutting fluid can be applied include materials comprising oxides or mixed oxides of any inorganic material whose oxide is solid at standard temperature and pressure. Also included are carbonates, aluminosilicates, silicates, and phosphates of any inorganic cation. Also included are materials in which two or more of these inorganic oxides are chemically combined or physically blended. Examples of this latter group include granite, limestone, sandstone and clays (which typically comprise aluminosilicates), as wells as inorganic pigments.

A transitional metalloid, silicon exhibits particular characteristics, in that it easily oxidizes. For instance, as a cutting tool exposes more silicon metal to the atmosphere in silicon wafer substrates, the silicon oxidizes instantly to form silicon-dioxide, to which the active head of each silane molecule can bind more readily to the oxygen atom than to the metal atom. In the case of fluoride crystals, such as LiF, $MgF_2$, $CaF_2$, or $BaF_2$, a fluoride atom becomes a leaving substituent; hence, allowing the silane to interact with the central atom to form, for example R—Si—O—Mg or R—Si—O—Ca, bonds to the substrate surface.

Hundreds of different, organic compounds may possibly be used as the organic material in the present inventive cutting fluid. The silane molecules used in an embodiment of the present invention can be expressed with the general formula of:

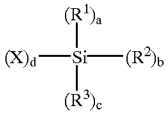

wherein a+b+c+d =4, and 1<d<4, and $R^1$, $R^2$, and $R^3$ each is a hydrocarbon or fluorocarbon structure selected from the following group: alkyl, branched, unbranched, phenylated, and X is selected from the following group: —OH, —O-alkyl, -halide.

Listed in Table 1, are a few specific examples of the compounds we believe to be good silanes, which can be dispersed in water with a surfactant or detergent to create the cutting fluid. These examples of possible compounds are by way of illustration only, and they are not exhaustive, nor should they be construed to be limiting. Other suitable compounds may be obvious to one skilled in the art. A common characteristic of all of these compounds is that they tend to form covalent bonds with hydroxyl or oxygen groups located on the surface of the respective substrate materials. The compounds consist of a leaving group attached to a silicon atom that is, in turn, connected to various kinds of R-groups. The R-groups comprise hydrocarbon chains that are of one or more carbons in length. Preferably the R-groups have carbon chains with more than 10 carbons. More specifically, in one embodiment we made a solution with a silane having an eighteen-carbon substitutent. The kinds of silanes or siloxanes incorporated in the present invention are generally available from chemical distributors, such as Gelest, Inc. in Tullytown, Pa., and prepared by methods known in the art. (See Kirk-Orthmer, *Encyclopedia of Chemical Technology,* 3rd Ed., vol. 20; and R. C. Mehrota, *Pure and Applied Chem.*, vol. 13, p. 111, 1966.)

TABLE 1

Examples of Functional Silanes & Siloxanes.

| Name | Molecular Weight | bp/mm (mp) |
|---|---|---|
| n-Decyldimethylchlorosilane<br>$CH_3(CH_2)_9$—Si—$(CH_3)_2$—Cl | 234.88 | 98°/2 |
| n-Decylmethyldichlorosilane<br>$CH_3(CH_2)_8CH_2$—Si—$CH_3$—$Cl_2$ | 255.31 | 111–114°/3 |
| n-Decyltrichlorosilane<br>$CH_3(CH_2)_8CH_2$—Si—$Cl_3$ | 275.72 | 133–137°/5 |
| n-Decyltriethoxysilane<br>$CH_3(CH_2)_8CH_2$—Si—$(OC_2H_5)_3$ | 304.54 | 150°/8 |

TABLE 1-continued

Examples of Functional Silanes & Siloxanes.

| Name | Molecular Weight | bp/mm (mp) |
|---|---|---|
| Cyclohexyldimethylchlorosilane<br>$C_6H_{11}$—Si—$(CH_3)_2$—Cl | 176.76 | 52–53°/2 |
| Cyclohexylethyldimethoxysilane<br>$C_6H_{11}$—Si—$(OCH_3)_2$—$C_2H_5$ | 202.37 | 81–85°/15 |
| Cyclohexylmethyldichlorosilane<br>$C_6H_{11}$—Si—$CH_3$—$Cl_2$ | 197.18 | 83°/15 |
| Cyclohexylmethyldimethoxysilane<br>$C_6H_{11}$—Si—$(OCH_3)_2$—$CH_3$ | 188.34 | 196° |
| (Cyclohexylmethyl)trichlorosilane<br>$C_6H_{11}$—$CH_2$—Si—$Cl_3$ | 231.62 | 94–98°/11 |
| Cyclohexyltrichlorosilane<br>$C_6H_{11}$—Si—$Cl_3$ | 217.60 | 90–91°/10 |
| Cyclohexyltrimethoxysilane<br>$C_6H_{11}$—Si—$(OCH_3)_3$ | 204.34 | 207–209° |
| Diethyldichlorosilane<br>$(CH_3CH_2)_2$—Si—$Cl_2$ | 157.11 | 130° |
| Diethyldiethoxysilane<br>$(CH_3CH_2)_2$—Si—$(OC_2H_5)_2$ | 176.33 | 157° |
| Dimethyldichlorosilane<br>$(CH_3)_2$—Si—$Cl_2$ | 129.06 | 70–71° |
| Dimethyldiethoxysilane<br>$C_2H_5O$—Si—$(CH_3)_2$—$OC_2H_5$ | 148.28 | 114–115° |
| Dimethyldimethoxysilane<br>$(CH_3)_2$—Si—$(OCH_3)_2$ | 120.22 | 82° |
| Diphenylchlorosilane<br>$(C_6H_5)_2$—Si—H—Cl | 218.76 | 143°/10 |
| Diphenyldichlorosilane<br>$(C_6H_5)_2$—Si—Cl | 253.20 | 304–305° |
| Diphenyldiethoxysilane<br>$(C_6H_5)_2$—Si—$(OC_2H_5)_2$ | 272.42 | 167°/15 |
| Diphenyldimethoxysilane<br>$(C_6H_5)_2$—Si—$(OCH_3)_2$ | 244.36 | 161°/15 |
| Dodecyldimethylchlorosilane<br>$CH_3(CH_2)_{10}CH_2$—Si—$(CH_3)_2$—Cl | 262.94 | 291–293° |
| Dodecylmethyldichlorosilane<br>$CH_3(CH_2)_{10}CH_2$—Si—$CH_3$—$Cl_2$ | 283.36 | 124–127°/3 |
| Dodecylmethyldiethoxysilane<br>$CH_3(CH_2)_{10}CH_2$—Si—$CH_3$—$(OC_2H_5)_2$ | 302.57 | 140°/0.5 |
| Dodecyltrichlorosilane<br>$CH_3(CH_2)_{10}CH_2$—Si—$Cl_3$ | 303.77 | 120°/3 |
| Dodecyltriethoxysilane<br>$CH_3(CH_2)_{10}CH_2$—Si—$(OC_2H_5)_3$ | 332.60 | 152–153°/3 |
| n-Hexadecyltrichlorosilane<br>$CH_3(CH_2)_{14}CH_2$—Si—$Cl_3$ | 359.88 | 202°/10 |
| Hexadecyltrimethoxylsilane<br>$CH_3(CH_2)_{14}CH_2$—Si—$(OCH_3)_3$ | 346.63 | 155°/0.2 |
| Triethylsilane<br>$(C_2H_5)_3$—Si—OH | 132.27 | 75°/24 |
| Trimethylmethoxylsilane<br>$(CH_3)_3$—Si—$OCH_3$ | 104.22 | 57–58° |
| 3-(p-Methoxyphenyl)propyltrichlorosilane<br>$CH_3O$—$C_6$—$CH_2CH_2CH_2$—Si—$Cl_3$ | 283.66 | 128–129°/1 |
| 3-Methoxypropyltrimethoxysilane<br>$CH_3O$—$CH_2CH_2CH_2$—Si—$(OCH_3)_3$ | 194.30 | 98–99°/40 |
| 2-[Methoxy(polyethyleneoxy)propyl]Trimethoxysilane<br>$CH_3O$—$(CH_2CH_2O)_{6-9}$—$(CH_2)_3$—Si—$(OCH_3)_3$ | 460–590 | |
| 3-Methoxypropyltrimethoxsilane<br>$CH_3O$—$CH_2CH_2CH_2$—Si—$(OCH_3)_3$ | 194.30 | 98–99°/40 |
| n-Octadecylmethoxydichlorosilane<br>$CH_3(CH_2)_{16}CH_2$—Si—$OCH_3$—$Cl_2$ | 383.51 | 144–147°/1.5 |
| n-Octadecylmethyldichlorosilane<br>$CH_3(CH_2)_{16}CH_2$—Si—$CH_3Cl_2$ | 367.52 | 185°/2.5 |
| n-Octadecylmethyldiethoxysilane<br>$CH_3(CH_2)_{16}CH_2$—Si—$(OC_2H_5)_2CH_3$ | 386.73 | 197°/2 |
| n-Octadecyldimethylchlorosilane<br>$CH_3(CH_2)_{16}CH_2$—Si—$(CH_3)_2Cl$ | 347.10 | 159°/0.1 |
| n-Octadecyltrichlorosilane<br>$CH_3(CH_2)_{16}CH_2$—Si—$Cl_3$ | 387.93 | 160–162°/3 |
| n-Octadecyltriethoxysilane<br>$CH_3(CH_2)_{16}CH_2$—Si—$(OC_2H_5)_3$ | 416.76 | 165–169°/2 |
| n-Octdecyltrimethoxysilane<br>$CH_3(CH_2)_{16}CH_2$—Si—$(OCH_3)_3$ | 374.68 | 170°/0.1 |

TABLE 1-continued

Examples of Functional Silanes & Siloxanes.

| Name | Molecular Weight | bp/mm (mp) |
|---|---|---|
| n-Octadecyldimethylmethoxsilane $CH_3(CH_2)_{16}CH_2—Si—(CH_3)_2—OCH_3$ | 342.68 | 184–186°/0.2 |
| n-Octadecyldimethyl-(dimethyl-(dimethylamino)-silane $CH_3(CH_2)_{16}CH_2—Si—(CH_3)_2—N(CH_3)_2$ | 355.72 | 160°/0.1 |
| Bis(2-Hydroxyethyl)-3-Aminopropyl-triethoxy-silane $(HOCH_2CH_2)_2—N—CH_2CH_2CH_2—Si—(OEt)_3$ | 309.48 | |
| Octadecyldimethyl-(3-Trimethoxysilyl-Propyl)Ammonium Chloride $CH_3(CH_2)_{17}—N^+—(CH_3)_2—CH_2)_3—Si—(OCH_3)_3$ $Cl^-$ | 496.29 | |
| N,N-Didecyl-N-Methyl-N-(3-Trimethoxysilyl-Propyl)Ammonium Chloride $(CH_3(CH_2)_9)_2—N^+—CH_3—(CH_2)_3—Si—(OCH_3)_3$ $Cl^-$ | 510.32 | |
| Trimethylpolydimethylsiloxane $(CH_3)_3—Si—O—(Si—(CH_3)_2—O)_n—Si—(CH_3)_2—OH$ | where n = 6 to 50 | |

The cutting fluid is prepared with commercially available organic molecules in a detergent suspension to about a 10% weight concentration in water, and diluted to about 0.1–1.0% when used. The viscosity of the cutting fluid is virtually the same as that of water, 0.01 poise (20° C.). The cutting fluid can be used over a wide temperature range from about 10° C. to about 90° C., virtually the same as for liquid water. When in use, the inventive cutting solution coats a workpiece and its immediate surrounding surfaces to a thickness of less than about 1 micron, in at least a monolayer. If necessary, after the cutting or machining process is completed, the residual organosilane coating can be removed by a variety of processes. Among the more preferred processes include heat ablation, ultraviolet/ozone cleaning, oxygen plasma degradation or chemical etching, such as with HF.

We believe that cutting fluid of this invention can be environmentally safe, non-toxic, and biodegradable. The cutting fluid poses no risk of fire, provides uniform coverage over the substrate and cutting tool surfaces, and imparts excellent lubricity to the substrate, which reduces chipping during the machining. Whereby, the lubricative properties of the silane molecules eliminate the adhesion of particulates that can potentially cause surface damage and reduces frictional pressures that can do subsurface damage. Moreover, since not as much energy that is directed to cutting is converted into heat, reducing friction and tool vibrations has the additional benefit of reducing energy consumption during the machining process. Furthermore, the cutting fluid does not detrimentally affect the substrate surface, and can potentially extend the cutting tool life. We also believe that, in one of many possible applications, the new inventive cutting fluid and the method of using it will improve many types of glass manufacturing operations including the cutting, milling, polishing, grinding of workpieces.

To illustrate, once a workpiece, made of material such as glass or ceramics, is continuously irrigated during the cutting and machining process with the inventive cutting fluid, the silane molecules that are dispersed in solution attach instantly to the substrate material and form a slipper surface coating. As the cutting tool exposes fresh glass, the silane molecules bond to the newly exposed cut-surfaces, creating a low friction layer between the cutting tool and the glass. The silanes also bond to the small particulates, such as glass chips, generated by the abrading or cutting process. Once coated with silane molecules to a thickness of from one to a few molecules, the particles or chips are prevented from readily bonding to each other or to the abrasive cutting surface on the machining tool, thus clogging the tool. When the cutting or abrading surface of the tool remains free (i.e., unclogged) of substrate particles that have been milled off, it can cut faster into the workpiece using less pressure and energy. This reduced pressure and friction, we believe, helps prevent the cutting tool from becoming over heated, promotes ease with which the glass is machined, removes more material, and creates a better, finished surface than previously achieved. Also, with less pressure the substrate is less prone to cracking and the forming of subsurface damage. While also reducing any cracking of the substrate material due to excessive pressure during the cutting, as an additional benefit the silane compounds form a coating on the substrate, protecting it from scratches or contaminants during the machining process. Hence, the cutting fluid improves the overall cutting and machining process by enabling faster substrate material removal without much surface or subsurface damage when cutting or drilling at increased speeds.

Using the inventive cutting fluid, a workpiece substrate appears to be able to withstand machining at faster cutting rates, FIG. 5, and still maintain smoother surfaces in relation to the prior art, FIG. 6. (Both FIGS. 5 and 6 will be discussed in more detail below.) Overall, samples that had been machined using the inventive cutting fluid seem to sustain less damage when comparing the roughness on surfaces of samples cut using the prior art. Such observations we believe indicate that the diamond cutting-surface of a circular saw blade, for instance, is kept from being jammed by microparticulates produced during the machining process.

It is contemplated that the tools and processes that will be used in conjunction with this inventive cutting generally are designed to perform abrading, cutting, drilling, machining, sawing, grinding, edging or polishing functions on vitreous, crystalline, or aggregate material substrates. One example of such tools is an abrading or cutting wheel. Typically, abrading or cutting wheels comprise a metal core such as stainless steel having an abrasive material such as a diamond-binder mixture affixed to either an outer circumferential edge or covering a surface of the wheel, respectively. Alternatively, the wheel may be made from any abrasive material such as silicon carbide, diamond, carborundum, aluminum oxide, etc., or mixtures of these materials. Grinding wheels may also be made with a surface covering molded from a mixture of any of the abrasive materials listed and a resin such as a phenol formaldehyde thermoset material. The cutting and grinding wheels are used typically for cutting or finishing workpieces, such as a planar sheet of glass or silicon wafer, or molded shapes of glass-ceramics, Corian® by DuPont or even stone such as granite, marble, or limestone. A specific example is that these abrading wheels may be employed to form rounded or beveled profiles on edges of glass sheets, which are used as door glazings in automobiles.

EXAMPLES

Having described the attributes of the present inventive cutting fluid, the cutting fluid was tested on some sample substrates. Although not intended to be bound by theory, it is hypothesize that the objective is accomplished in a manner such that the organic cutting fluid forms a lubricating interface between the substrate surface and the machining tool, keeping the tool clean and its cutting surfaces free of clogging particle build-up, thereby preventing the tool and substrate, both, from either overheating or cracking under pressure by excess friction. To test the cutting fluid, we set up an experimental apparatus, as shown as a schematic drawing in FIG. 1. The apparatus comprised an irrigation pump mechanism 2 with flow tube to dispense a cutting fluid 1 from a container 3, onto a diamond-edged table saw 4 (Target Products tile saw, ¾ HP motor @1735 rpm), which was run at a constant speed. A workpiece 6 was cut with an applied constant force f. A three-pound weight 7 is attached by a wire 7*a* to a free sliding cart 8. On the cart rested a fused silica or granite sample workpiece 6. The cart 8, with the workpiece sample 6 on board, is pulled through the sawing process under constant force f. As the cutting process begins, the inventive cutting fluid is applied continuously to the surfaces of the workpiece 6 and the effective cutting surfaces of the saw blade 4.

Figure 2:
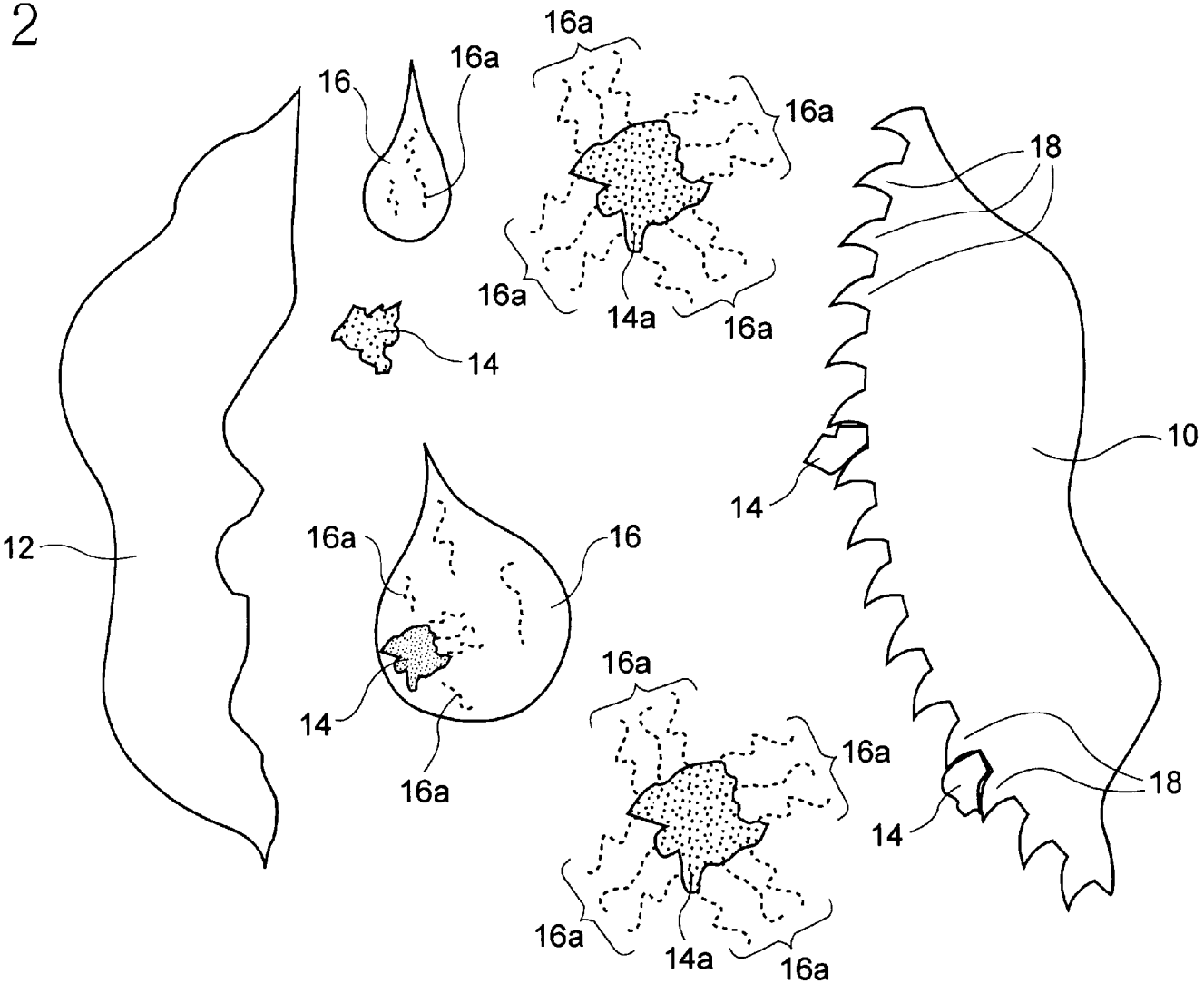
FIG. 2. An enlarged view of a cutting tool and a workpiece substrate from which particles are milled, and free particles, all of which have been coated with the inventive organic cutting fluid.

Illustrative of the way the inventive cutting fluid works, FIG. 2 shows an enlarged schematic view of a cutting tool, which is here a saw blade 10. The saw blade is milling a workpiece 12 of a vitreous, crystalline, or aggregate substrate. From the workpiece, small particles 14 of the material are being cut and coated 14*a* with the inventive organic cutting fluid 16. Indeed all surfaces represented are being coated. Note that the silane molecules 16a have covalently bonded to the coated particles 14*a* suspended in the aqueous solution. As distinguished from the prior art using water alone, the particles 14 for the most part tend not to clog the cutting teeth 18 or abrasive surface of the saw blade 10, nor binding to the substrate 12 or to each other. Therefore, the cutting tool will cut faster, smoother with less vibration and pressure, with less expense of energy, and causing less surface and subsurface damage, because the abrasive cutting teeth remain free of substrate particles 14.

First, as an experimental control, water alone was used as the cutting fluid in a run that cut a 1.4 inch thick slab of fused silica. Then a second run was performed on the same piece of fused silica, but this time employing the inventive cutting fluid 16 containing organosilanes 16*a*. A freshly dressed diamond-edged saw wheel (American Diamond Tool, 8 inch diameter, ⅛ inch thick wheel, metal bonded diamond 80 grit, 50-concentration, MD80, N50, MB-⅛.) was used before each run. The irrigating mechanism 2 was started as soon as the saw blade 4 started to rotate, and a timer was started as soon as the fused silica substrate made contact with the saw. We cut the sample for 60 seconds on each run. We repeated this experimental process several times for each type of cutting fluid, water alone or containing organosilane molecules. In these experiments we used a 0.5% concentration of $C_{18}$-hydrocarbon silane dispersed in aqueous solution, specifically TLF-8291 from DuPont. The workpiece sample was then measured for depth of cut and the amount of material removed, and the results from each run compared. The results, given in Table 2, show that the organosilane cutting fluid improved the rate and amount of material removed by 250–300 percent over using water alone.

TABLE 2

Fused Silica

| Sample | Run No. | Cutting Fluid | Time (Sec.) | Amt. Materials Removed ($mm^3$) |
|---|---|---|---|---|
| 1.4" thick fused silica slab | 1 | Water (Prior Art) | 60 | 930 |
| | 2 | | 60 | 880 |
| | 3 | | 60 | 850 |
| | 4 | | 60 | 970 |

TABLE 2-continued

Fused Silica

| Sample | Run No. | Cutting Fluid | Time (Sec.) | Amt. Materials Removed ($mm^3$) |
|---|---|---|---|---|
| | 5 | 0.5% $C_{18}$-silane in aqueous solution | 60 | 2560 |
| | 6 | | 60 | 2550 |
| | 7 | | 60 | 2800 |

The experiment was repeated several times using a granite workpiece sample. A 1.25 inch thick piece of granite ("Luna Pearl", obtained from the Ithaca Tile Co., Ithaca, N.Y.) was cut with the diamond-edged saw at constant force for 60 seconds. The results, summarized in Table 3, show that the organosilane cutting fluid improved cutting by 200–220 percent over using water alone.

TABLE 3

Granite

| Sample | Run No. | Cutting Fluid | Time (Sec.) | Amt. Materials Removed ($mm^3$) |
|---|---|---|---|---|
| 1.25" thick granite slab | 8 | Water (Prior Art) | 60 | 740 |
| | 9 | | 60 | 790 |
| | 10 | | 60 | 770 |
| | 11 | | 60 | 780 |
| | 12 | 0.5% $C_{18}$-silane in aqueous solution | 60 | 1580 |
| | 13 | | 60 | 1500 |
| | 14 | | 60 | 1620 |
| | 15 | | 60 | 1650 |

FIG. 5 illustrates the comparative relationship that exists between the amount of substrate material removed from a workpiece—the distance cut into the substrate—when machined using the prior art and the inventive cutting fluids respectively, when a constant force is applied. FIG. 5 plots the applied force (x-axis) against amount of material removed (y-axis) during a 60 second run of two workpieces. The first workpiece is irrigated with water alone and the second one is irrigated with the inventive cutting fluid. For a certain known amount of constant force the sample that is cut using the prior art fluid (water) does not remove as much material as a cut made using the inventive cutting fluid. On the other hand, the inventive cutting fluid seems to permit a free-cutting tool, such as the tile saw, to go farther and cut deeper into a workpiece, hence, removing more material. Experimental use on high purity fused silica, as well as other glass, glass-ceramic and granite samples, tend to demonstrate that a diamond tipped tile saw can slice more easily through the substrate body, yet causes less subsurface microfractures or other damage than the prior art, when water alone had been employed.

The silane containing cutting fluid may be recycled. Any excess fluid is collected and any substrate particles are allowed to settle-out or filtered out of solution. To reiterate, if necessary the coating is easily removed from the substrate or work tools by heat, HF or ozone etching, or oxygen plasma.

Figure 3:
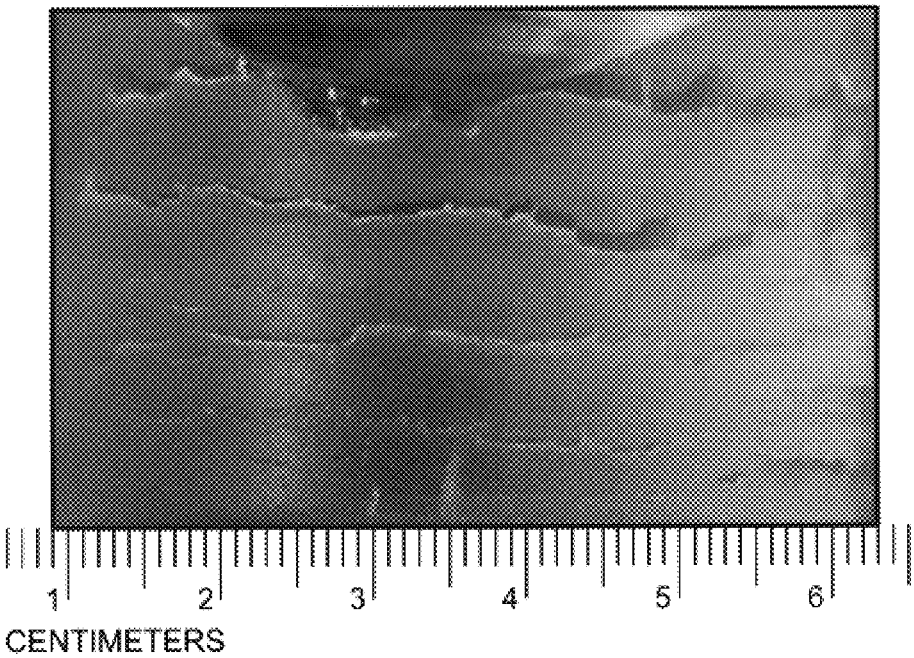
FIG. 3. A photograph of the surface of a silica core drilled using prior art water coolant alone, showing the cracking and subsurface damage caused in the cutting process.

In the past, core drilling silica articles using water coolant alone have proven to be unsatisfactory. Frequently, the core samples suffer a great amount of surface and subsurface damage. FIG. 3 is a photograph of an experimental core sample, which is representative of many silica cores that are diamond-bit-drilled with water coolant alone. Note the large cracks and fissures along the surface of the core cylinder.

The cracks are greater than 2 mm in width, thereby large enough to cause substantial subsurface damage of at least 1 mm or deeper, and overall marring of the outer cut surface. To redress damage such as those shown requires that the outer damaged layers be ground-off to the depth of the deepest cracks and additional polishing to finish the surface. This extra effort adds not only to manufacturing coats, but also increases production time and the amount of waste generated.

Damage such as that shown in FIG. 3 stems from glass particles or chips, created in the coring process, binding together and clogging the cutting teeth of the diamond-tipped coring drill. As more and more waste particles accumulate, the more difficult it becomes for the drill to work smoothly and evenly against the silica substrate. More and more force is required to push the drill through the substrate. Consequentially, the aggregate friction caused by the accumulation of particles on the cutting teeth of the drill eventually builds up to such a point when the cutting tool may seize-up. Additional force or pressure to push or progress forward leads to fractures forming in the surface of the silica core; because, the stress forces must be relieved before the drill can progress any further into the substrate under friction.

Figure 4:
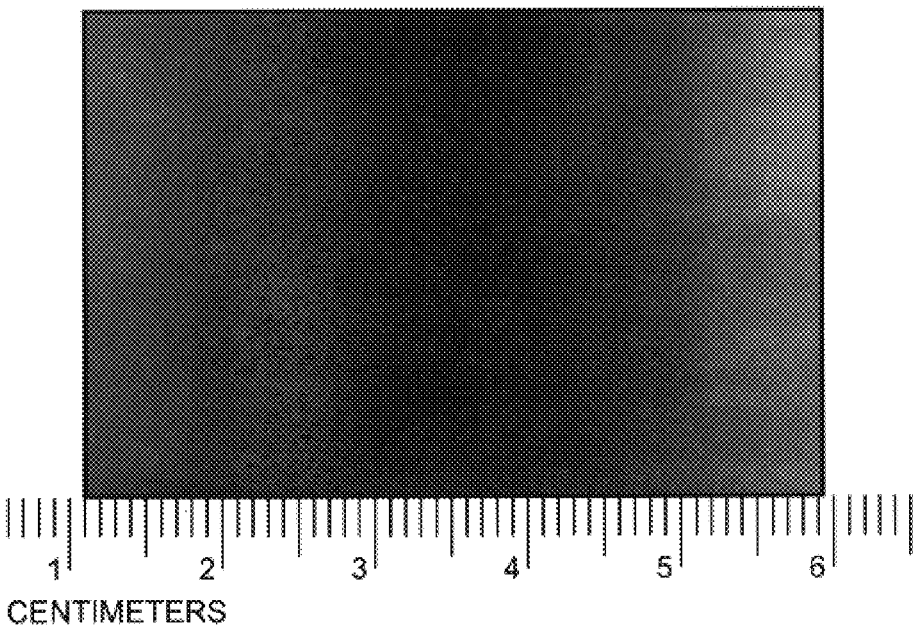
FIG. 4. A photograph of the surface of a silica core drilled using the inventive cutting fluid, showing the absence of cracks and subsurface damage.

In a second coring run, we kept all other conditions and the feed rate the same as before, except instead of water alone as the lubricant, we used the inventive cutting fluid. A fresh diamond bit was used on a new piece of silica that was identical to the piece drilled before. In contrast to the damage shown in FIG. 3, FIG. 4, a photograph of this second experimental core of silica, shows little to no damage. A 0.5% concentration of a $C_{18}$-hydrocarbon silane ($C_{18}H_{37}Si(OH)_3$) with a detergent, available from DuPont (TLF-8291), dispersed in aqueous solution was applied during the coring process, to produce a clear, smooth cut, with no cracking. The diamond drill remained unclogged. The cutting fluid coated both the drill teeth surfaces and the glass chip particles immediately as they were abraded from the silica substrate. The coating prevented the glass particles from binding to each other, or the diamond abrasive.

In a series of experiments that involved core drilling glass samples, a radial drill press (Lincoln RL84TRP-1230) that was fitted with a 2.4-inch-diameter diamond, core drill (Hoffman Diamond Products, Punxutawney, Pa.), having a 100 grit 100 concentration MB was applied. The drill was set at 140 rpm and a feed rate of about 0.006 to 0.0154 inches per second. Samples upon which only a water coolant or lubricant were applied resulted in large cracks like those shown in FIG. 3. Other samples that were machined with a version of the inventive cutting solution, like in FIG. 4, again exhibited no fracturing of the cut surfaces. After core-drilling, we measured the surface roughness on several areas of the samples. To obtain analogous comparisons in the case of the samples irrigated only with water, we measured the spots where there were no visible cracks. Micro-surface roughness was measured by using a Taylor Hobson Formtalysurf instrument. Table 4 presents the relative surface roughness of two typical workpiece samples. One sample is machined—specifically drilled—using water alone as the lubricant. The other sample is similarly worked using an embodiment of the inventive silane solution.

TABLE 4

| | Surface Roughness (micro-inches) | |
|---|---|---|
| Cutting Fluid | Along Direction of Feed | Around Core Circumference |
| $H_2O$ | 153 (plus 40,000–80,000 $\mu$ inch fractures) | 210 (plus 4,000–80,000 $\mu$ inch fractures) |
| 0.5% $C_{18}$ silane (similiar to that in Example #1) | 265 | 242 |

The micro-surface of the first workpiece, irrigated with water alone, although appearing to have a slightly smoother surface in certain sections, is in the aggregate actually much rougher than the micro-surface of the sample cut with a $C_{18}$ silane in aqueous solution. The large cracks or fissures formed along the surface of this first workpiece greatly increase its overall roughness. These fractures run deep into the substrate and can range from about 40,000 to about 80,000 microinches. Hence, the actual overall amount of damage and roughness of a sample cut with water alone runs off the scale of measurement for machined pieces of the present invention. In contrast, the samples machined with the silane solution avoid the formation of huge fractures in the workpiece.

FIG. 6 illustrates in graphical form the relative relationship between the cutting rate and surface roughness for the samples irrigated with water alone and with the inventive cutting fluid. FIG. 6 shows a logarithmic plot of the observed relative surface roughness. The feed rate is plotted on the x-axis, and the surface roughness on the y-axis. Comparing a first workpiece, irrigated with water alone, against a second one, irrigated by the cutting fluid, its is clearly apparent that the first sample has a rougher surface than the second sample by nearly a factor of a thousand. The data demonstrate that the inventive cutting fluid keeps the diamond cutting edges of the coring-drill free from clogging particles, which in this case happen to be freshly milled glass (fused silica) particulates.

Generally, the less clogged and more exposed the cutting edge is, as a result of using the inventive cutting solution, the more material the machining process can remove and the more efficiently the tool will cut. In a single pass, more material can be removed than that which can be done currently under commercial conditions. The inventive cutting fluid also enables the cutting edges, to remain sharp, with the maximum number and full length of each cutting edge exposed to abrade into the workpiece substrate, over the entire machining process. Although the water cutting fluid and the inventive cutting solution each begin cutting at relatively the same roughness, over a short time and at progressively higher machining speeds, one can see a clear difference in roughness. A workpiece made with the inventive cutting solution is able to maintain relatively the same surface roughness. While, in contrast, with a workpiece made using water, the surface roughness rapidly increases. Up to a point, a workpiece irrigated with water alone starts to experience stresses at much higher speeds that cause fracturing of the substrate, which can be readily seen in FIG. 3. Use of the inventive cutting fluid maintains the cutting edge in a clean condition, which permits a workpiece to better tolerate higher feed rates or cutting speeds. Consequentially, a workpiece can be finished faster than it is now done.

The cutting fluid has also shown a likeliness to help produce an easier cut when used upon other materials, in addition to glass, including glass ceramics, high purity fused-silica, fluoride crystals, rock, concrete and silicon. By using the inventive cutting fluid, workers may experience several other advantages. Since, the fluid enables the machining tool to work more efficiently, removing more material with less damage, workers may save time in the machining process and save finishing costs that are incurred when removing substantial subsurface and surface damage on the material. With less damage, less material needs be polished or ground off during the finishing process, again saving on costs for materials and preventing waste. Finally, given the savings in time, materials and money during the finishing step, the inventive fluid tends to enable a worker to process a workpiece to its near-net form or shape faster and more easily than currently used water cutting fluids do.

Other situations where the inventive cutting fluid could be used are in drilling and rock excavation such as that performed in oil and nature gas exploration or the mining and mineral development industries. In addition, the cutting fluid can benefit the dimension stone industry, the construction industry and any other industry that is involved in the cutting, drilling, grinding, abrading, or polishing of stone, concrete, asphalt, or coal, for example, or in tunneling through rock.

To illustrate the potential benefits of the present inventive cutting fluid to, say, the mining industry, consider the following. In 1990, drill bits used in the mining industry cost about 600 million dollars per year or about 40 percent of the total drilling costs. Increasing the useful life of each bit by 100 percent can translate into yearly savings or 300 million dollars in drill bit costs. Thus, significant cost saves can be achieved if there is a way to prolong the useful life of drill bits. As described generally above, by employing the inventive cutting fluid solution when operating a drill bit, we believe that the drill bit will be able to greatly enhance the total amount of material removed when cutting or penetrating rock, and increase the cutting or penetration rate of rock drilling or tunneling systems, while simultaneously extending the useful life of the bit or any other cutting tool.

Previously it was found that maximum increases in penetration can be obtained simultaneously with maximum increases in bit life by using concentrations of chemical additive solutions, such as cationic organic surfactant and inorganic salt solutions. These systems, however, only temporarily neutralize the naturally occurring negative charge on a rock surface. The underlying charge of the rock surface remains even with titration. We believe that the inventive cutting fluid, using organic silane molecules, constitutes an improvement for this application, since it does not require the titration of charge, as described in some mining literature, on the rock surface or particles that are ground from the rock. Instead, the silane molecules form covalent bonds with the inorganic surface. This removes the charge-ion system completely.

The inventive cutting fluid compositions described herein are suitable for use when machining a variety of vitreous, crystalline, or aggregate material substrates. Although the present invention has been fully described by way of examples, it is to be noted that various changes and modifications will be apparent to those skilled in the art. Therefore, unless such changes and modifications otherwise depart from the scope of the present invention, they should be construed as included herein.

We claim:

1. A cutting fluid for use in machining vitreous, crystalline, or aggregate materials, the cutting fluid comprising a solution containing at least one type of the following organic molecules: silanes, siloxanes, silanols, or cationic phosphonium compounds, wherein a molecule of said silanes, siloxanes or silanols has a leaving group.

2. The cutting fluid according to claim 1, wherein said silane is represented by the general structural formula of:

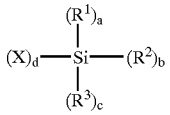

wherein a+b+c+d=4, and $1 \leqq d < 4$ and $R^1$, $R^2$, and $R^3$ each is a hydrocarbon or fluorocarbon of either an alkyl, branched, unbranched, phenylated, or cyclic structure; and wherein X is selected from the following group: —OH, —halide, —O-alkyl when d is less than 3.

3. The cutting fluid according to claim 2, wherein at least one of said R-groups is at least 6 carbons in length when not either an alkyl or alkoxy radical.

4. The cutting fluid according to claim 2, wherein at least one of said R-groups is at least 8 carbons in length.

5. The cutting fluid according to claim 2, wherein said silane is a $C_{18}$-hydrocarbon silane.

6. The cutting fluid according to claim 1, wherein said solution contains cationic silanes.

7. The cutting fluid according to claim 1, wherein said cutting fluid is an aqueous solution in which said organic molecules are dispersed to about a 10% weight concentration.

8. The cutting fluid according to claim 1, wherein said materials include inorganic oxides, or mono-crystals or poly-crystals.

9. The cutting fluid according to claim 1, wherein said materials include carbonates, aluminosilicates, silicates, and phosphates of any inorganic cation.

10. The cutting fluid according to claim 1, wherein said materials include two or more inorganic oxides either chemically combined or physically blended.

11. The cutting fluid according to claim 1, wherein said vitreous or crystalline materials comprise glass, glass ceramics, or ceramics.

12. The cutting fluid according to claim 1, wherein said vitreous material is high purity fused silica.

13. The cutting fluid according to claim 1, wherein said vitreous material is an optical glass.

14. The cutting fluid according to claim 1, wherein said crystalline material is silicon.

15. The cutting fluid according to claim 1, wherein said crystalline materials include fluoride crystals.

16. The cutting fluid according to claim 15, wherein said fluoride crystals includes LiF, $MgF_2$, $CaF_2$, or $BaF_2$.

17. The cutting fluid according to claim 16, wherein said fluoride crystals is $CaF_2$.

18. The cutting fluid according to claim 1, wherein when machining aggregate materials molecules of said silanes, siloxanes, or silanols in solution each have a R-group of at least 8 carbons in length when said R-group is either an alkyl or alkoxy radical.

19. The cutting fluid according to claim 1, wherein said cutting fluid forms a self-assembled monolayer on said materials and any particles thereform.

20. The cutting fluid according to claim 1, wherein said solution removes any vitreous or crystalline particles or other contaminants generated during said machining.

21. The cutting fluid according to claim 1, wherein said solution substantially reduces physical vibrations, and reduces friction at a tool-workpiece interface.

22. A cutting fluid for use in machining vitreous, crystalline, or aggregate materials, the cutting fluid comprising a solution containing molecules of at least one type of organosilane or cationic phosphonium compounds, wherein said molecules of organosilane each have a R-group of at least 7 carbons in length when said R-group is either an alkyl or alkoxy radical.

23. The cutting fluid according to claim 22, wherein said cutting fluid forms a self-assembled monolayer on said materials and any particles therefrom.

24. The cutting fluid according to claim 22, wherein said organosilanes includes: silanes, siloxanes, silanols.

25. The cutting fluid according to claim 22, wherein said materials include inorganic oxides, or mono-crystals or poly-crystals.

26. The cutting fluid according to claim 22, wherein said materials include two or more inorganic oxides either chemically combined or physically blended.

27. A method of machining substrate materials, the method comprising: providing a cutting fluid comprising a solution containing molecules of at least one type of organosilane or cationic phosphonium compound, wherein each molecule of said organosilane has a leaving group; providing a substrate of vitreous, crystalline, or aggregate material; applying said cutting fluid to said substrate material; and machining said material with said cutting fluid thereon.

28. The method according to claim 27, wherein said applying and machining steps are executed simultaneously.

29. The method according to claim 27, wherein said cutting fluid is an aqueous solution in which said organic molecules are dispersed to about a 10% weight concentration.

30. The method according to claim 27, wherein said organosilane molecules includes: silanes, siloxanes, silanols.

31. The method according to claim 27, wherein said organosilane is represented by the general structural formula of:

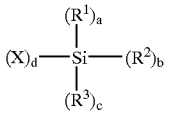

wherein a+b+c+d=4, and $1 \leqq d < 4$, and $R^1$, $R^2$, and $R^3$ each is a hydrocarbon or fluorocarbon of either an alkyl, branched, unbranched, phenylated, or cyclic structure; and wherein X is selected from the following group: —OH, —halide, —O-alkyl when d is less than 3.

32. The method according to claim 31, wherein at least one of said R-groups is at least 8 carbons in length.

33. The method according to claim 31, wherein at least one of said R-groups is at least 10 carbons in length.

34. The method according to claim 31, wherein said organosilane is a $C_{18}$-hydrocarbon silane.

35. The method according to claim 31, wherein said cutting fluid forms a self-assembled monolayer on said materials and any particles therefrom.

36. The method according to claim 27, wherein a molecule of said organosilane has a leaving group.

37. The method according to claim 27, wherein said solution contains cationic silanes.

38. The method according to claim 27, wherein said machining step is performed with substantially reduced physical vibrations, and reduced friction at a tool-workpiece interface.

39. The method according to claim 27, wherein said vitreous, crystalline, or aggregate material is selected from the group consisting of inorganic oxides, mono-crystals and poly-crystals.

40. The method according to claim 27, wherein said solution removes any vitreous, crystalline, or aggregate particles or other contaminants generated during said machining step.

41. The method of according to claim 27, wherein said machining step comprises a cutting step.

42. The method according to claim 27, wherein said machining step is one selected from the group consisting of: an abrading, cutting, sawing, grinding, edging, or polishing step.

43. The method according to claim 27, wherein said vitreous, crystalline or aggregate material comprises glass, glass ceramics, or ceramics.

44. The method according to claim 27, wherein said vitreous material is high purity fused silica.

45. The method according to claim 27, wherein said vitreous material is an optical glass.

46. The method according to claim 27, wherein said crystalline material is silicon.

47. The method according to claim 27, wherein said crystalline materials are fluoride crystals.

48. The method according to claim 47, wherein said fluoride crystals include LiF, $MgF_2$, $CaF_2$, or $BaF_2$.

49. The method according to claim 27, wherein said vitreous, crystalline, or aggregate material has a form selected from one of the following consisting of: slab, wafer, bulk-solid, sheet, disk, washer, cane, tube, cone, and ribbon.

50. A machining method, the method comprising: providing a cutting fluid comprising a solution containing molecules of at least one type of organosilane or cationic phosphonium compound; providing a substrate material consisting essentially of inorganic oxides, mono-crystals and poly-crystals; applying said cutting fluid to said substrate material; and machining.

51. The method according to claim 50, wherein said applying and machining steps are executed simultaneously.

52. The method according to claim 50, wherein said cutting fluid is an aqueous solution in which said organic molecules are dispersed to about a 10% weight concentration.

53. The method according to claim 50, wherein said organosilane is represented by the general structural formula of:

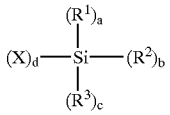

wherein a+b+c+d=4, and $1 \leqq d < 4$, and $R^1$, $R^2$, and $R^3$ each is a hydrocarbon or fluorocarbon of either an alkyl, branched, unbranched, phenylated, or cyclic structure; and wherein X is selected from the following group: —OH, —O-alkyl, -halide.

54. The method according to claim 53, wherein at least one of said R-groups is at least 8 carbons in length.

55. The method according to claim 53, wherein at least one of said R-groups is at least 10 carbons in length.

56. The method according to claim 53, wherein said organosilane is a $C_{18}$-hydrocarbon silane.

57. The method according to claim 50, wherein said cutting fluid forms a self-assembled monolayer on said materials and any particles therefrom.

58. The method according to claim 50, wherein a molecule of said organosilane has a leaving group.

59. The method according to claim 50, wherein said cutting fluid forms a self-assembled monolayer on said materials and any particles therefrom.

60. The method according to claim 50, wherein said machining step is performed with substantially reduced physical vibrations, and reduced friction at a tool-workpiece interface.

61. The method according to claim 50, wherein said machining step is one selected from the group consisting of: an abrading, cutting, sawing, grinding, edging, or polishing step.

62. The method according to claim 50, wherein said substrate material comprises glass, glass ceramics, or ceramics.

63. The method according to claim 50, wherein said substrate material is high purity fused silica.

64. The method according to claim 50, wherein said substrate material is an optical glass.

65. The method according to claim 50, wherein said substrate material is silicon.

66. The method according to claim 50, wherein said substrate material includes fluoride crystals.

67. The method according to claim 66, wherein said fluoride crystals include LiF, $MgF_2$, $CaF_2$, or $BaF_2$.

68. The method according to claim 50, wherein said substrate material includes two or more inorganic oxides either chemically combined or physically blended.

69. A cutting fluid for use in machining vitreous, glass-ceramic, non-oxide or non-metallic crystalline materials comprising a solution containing at least one type of organic molecule selected from the group consisting essentially of an organosilane, siloxane, silanol, or cationic phosphonium compounds, wherein said molecules have a leaving group.

70. The cutting fluid according to claim 69, wherein said solution is an aqueous solution.

71. The cutting fluid according to claim 69, wherein said silane is represented by the general structural formula of:

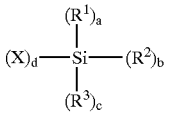

wherein a+b+c+d=4, and $1 \leqq d < 4$, and $R^1$, $R^2$, and $R^3$ each is a hydrocarbon or fluorocarbon structure selected from the following group: alkyl, branched, unbranched, phenylated, or cyclic; and wherein X is selected from the following group: —OH, —halide, or —O-alkyl when d is less than 3.

* * * * *